United States Patent [19]

Jünghans

[11] Patent Number: 4,708,059

[45] Date of Patent: Nov. 24, 1987

[54] INKING UNIT FOR ROTARY PRINTING MACHINES

[75] Inventor: Rudi Jünghans, Wilhelmsfeld, Fed. Rep. of Germany

[73] Assignee: Heidelberger Druckmaschinen AG, Heidelberg, Fed. Rep. of Germany

[21] Appl. No.: 903,264

[22] Filed: Sep. 3, 1986

[30] Foreign Application Priority Data

Sep. 3, 1985 [DE] Fed. Rep. of Germany ..... 3531433

[51] Int. Cl.[4] ..... B41F 31/06; B41F 31/16

[52] U.S. Cl. ..... 101/350; 101/DIG. 7

[58] Field of Search ..... 101/348, 349, 307, 350, 101/351, 207, 208–210, 148, DIG. 7, 321, 330, 335, 336, 340, 355, 363; 118/257, 259

[56] References Cited

U.S. PATENT DOCUMENTS

| | | | |
|---|---|---|---|
| 688,172 | 12/1901 | Hawes | 101/DIG. 7 |
| 877,570 | 1/1908 | Kroenert | 101/DIG. 7 |
| 1,611,039 | 12/1926 | Jackson | 101/DIG. 7 |
| 1,840,009 | 1/1932 | Ball et al. | 101/DIG. 7 |
| 2,036,451 | 4/1936 | Wood | 101/DIG. 7 |
| 2,622,522 | 12/1952 | Trozmuller | 101/DIG. 7 |
| 4,404,908 | 9/1983 | Simeth | 101/349 |
| 4,404,909 | 9/1983 | Fischer | 101/350 |
| 4,454,813 | 6/1984 | Barrois et al. | 101/DIG. 7 |
| 4,488,485 | 12/1984 | Bolza Shunemann | 101/350 |
| 4,593,617 | 6/1986 | Morikawa et al. | 101/DIG. 7 |

FOREIGN PATENT DOCUMENTS

| | | | |
|---|---|---|---|
| 2079221 | 1/1982 | United Kingdom | 101/349 |

*Primary Examiner*—J. Reed Fisher

*Attorney, Agent, or Firm*—Herbert L. Lerner; Laurence A. Greenberg

[57] ABSTRACT

Inking unit for a rotary printing machine having an ink duct, a relatively slowly rotating ink duct roller and following form and distributor rollers rotating at the same peripheral speed as that of a plate cylinder of the printing machine, includes an endless ink transfer belt located downstream from the ink duct roller in transfer direction of ink from the ink duct, the endless ink transfer belt extending laterally across the length of the ink duct roller and having one strand thereof engaging the outer cylindrical surface of the ink duct roller, the other strand of the endless ink transfer belt engaging the outer cylindrical surface of the next distributor roller disposed downstream from the endless ink transfer belt, and guide rollers engaging and guiding the endless ink transfer belt.

6 Claims, 3 Drawing Figures

INKING UNIT FOR ROTARY PRINTING MACHINES

Figure 1:
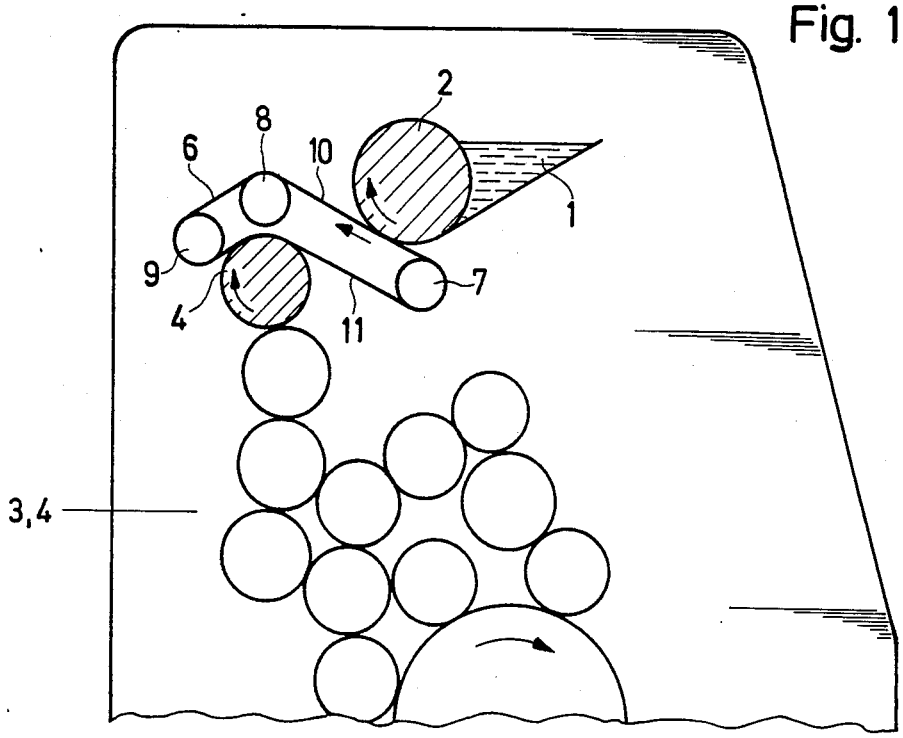

The invention relates to an inking unit for rotary printing machines and, more particularly, to such an inking unit having a slowly rotating ink duct roller and following inking or form rollers and distributor rollers rotating with the same peripheral velocity as that of the plate cylinder.

Such inking units for letter presses and offset presses are generally known and serve for feeding a thin ink film, which is as uniform as possible, to the plate cylinder. Conventional inking units can be divided into two groups: so-called film inking units and so-called vibrator inking units. In film inking units, an uninterrupted i.e. continuous, ink film is taken off the ink duct roller and fed to the printing plate. Metering of the amount of ink is effected, in this case, by rotary speed differences between the ink duct roller and the film roller and by suitable ink zone adjustments at the inking knife. A disadvantage of this type of inking unit is that, due to the considerable difference in speed between the ink duct roller and the film roller, a very fine quality of or highly efficient rolling-off of the ink duct roller and the film roller on one another is necessary in order to avoid metallic contact at the given slight spacing therebetween. When opposite directions of movement of the respective outer cylindrical surfaces have also been chosen for the ink transfer, naturally also a considerable development of heat is generated. This is a direct cause of a change in the ink film to be transferred. Although this type of inking unit thus indeed transfers a closed or continuous ink film, the operation thereof in actual practice is very sensitive and susceptible to failure.

Inking units of the other group, namely the vibrator inking units, have a so-called vibratory roller which is used for transferring ink from the ink duct roller to the first distributor roller, the vibratory roller executing an oscillating reciprocatory movement. The vibratory roller, in this regard, briefly engages the ink duct roller and takes up an ink strip of given width. Thereafter, it swings into contact with the first distributor roller and transfer this ink film to the outer surface of the latter. In the process, an abrupt acceleration of the vibratory roller occurs and when the vibratory roller swings back to the ink duct roller, a suitable deceleration of the vibratory roller occurs. The ink strip transferred to the ink rollers of the inking unit must then be processed therein to a uniformly thin ink film by a multiplicity of the ink rollers. A disadvantage of this type of inking unit is found in the movement of the vibrator roller as such and in the varying acceleration and deceleration thereof. Furthermore, especially when a relatively small amount of ink is required, a very narrow ink film is transferred to the ink rollers of the inking unit so that great technical expense is necessary for processing it into a uniformly thin ink film.

Departing from this state of the art, it is an object of the invention to provide an inking unit for rotary printing machines having an intermediate member located between the ink duct roller and the first distributor roller, a uniform ink film being feedable by the intermediate member to the ink rollers of the inking unit, the intermediate member being sensitively adjustable with relatively little expense and being unaffected by mechanically caused irregularities.

With the foregoing and other objects in view, there is provided, in accordance with the invention, an inking unit for a rotary printing machine having an ink duct, a relatively slowly rotating ink duct roller and following form and distributor rollers rotating at the same peripheral speed as that of a plate cylinder of the printing machine, including an endless ink transfer belt located downstream from the ink duct roller in transfer direction of ink from the ink duct, the endless ink transfer belt extending laterally across the length of the ink duct roller and having one strand thereof engaging the outer cylindrical surface of the ink duct roller, the other strand of the endless ink transfer belt engaging the outer cylindrical surface of the next distributor roller disposed downstream from the endless ink transfer belt, and guide rollers engaging and guiding the endless ink transfer belt. With this construction according to the invention, none of the rollers, which are fixedly mounted i.e. rotatable but not movable longitudinally or laterally, come into direct rolling contact with one another so that, for example, uneven or noncircular rotation thereof cannot occur. Moreover, uniform ink transfer is assured by the relatively simple construction and the relatively smooth, impact-free running of the transfer element or belt. The ink transfer belt according to the invention provides a long drying distance for the return flow of dampening medium which simultaneously serves as a cooling distance, so that only relatively slight heat build-up is to be expected which has no disruptive effect.

In accordance with another feature of the invention, one of the endless ink transfer belt partly surrounds and is driven by the next distributor roller.

In accordance with a further feature of the invention, one of the guide rollers has a drive with means for controlling the speed of the endless ink transfer belt.

In accordance with an added feature of the invention, one of the guide rollers is adjustably mounted.

In accordance with an additional feature of the invention, one of the guide rollers is resiliently mounted.

In accordance with a concomitant feature of the invention, one of the guide rollers carries a respective guide pulley on opposite ends thereof for guiding the endless ink transfer belt.

The foregoing advantageous features ensure the possibility of varying, over the width of the rollers, the amount of ink fed to the inking unit.

Other features which are considered as characteristic for the invention are set forth in the appended claims.

Although the invention is illustrated and described herein as embodied in inking unit for rotary printing machines, it is nevertheless not intended to be limited to the details shown, since various modifications and structural changes may be made therein without departing from the spirit of the invention and within the scope and range of equivalents of the claims.

Figure 2:
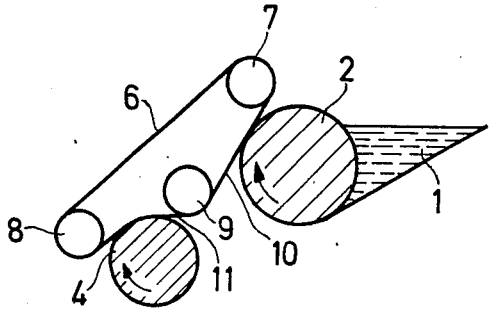
Figure 3:
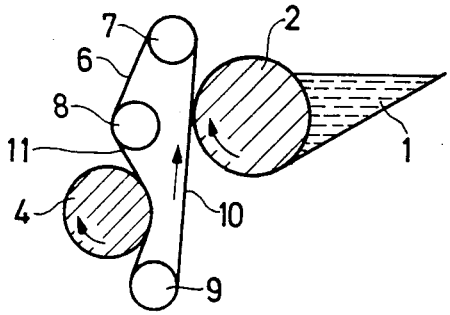

The construction and method of operation of the invention, however, together with additional objects and advantages thereof will be best understood from the following description of specific embodiments when read in connection with the accompanying drawing, in which:

FIG. 1 is a diagrammatic view of an inking unit and the roller layout thereof; and FIGS. 2 and 3 are fragmentary views of FIG. 1 showing different embodiments of the inventive construction forming part of the inking unit.

Referring now to the drawing and first, particularly, to FIG. 1 thereof, there is shown therein an inking unit formed of an ink duct 1, a relatively slowly rotating ink duct roller 2 and several ink rollers including form rollers 3 and distributor rollers 4 by which a printing plate of a plate cylinder 5 is inked.

According to the invention, an ink transfer belt 6 is disposed after or downstream from the ink duct roller 2 in transfer direction of the ink from the ink duct 1, the belt 6 extending laterally i.e. into and out of the plane of the drawing, over the length of ink duct roller 2 and the next following distributor roller 4, and being formed with a conventional blanket or rubber covering. This ink transfer belt 6 is of endless construction and is looped around guide rollers 7, 8 and 9. In accordance with the embodiment illustrated in FIG. 1, a strand or run 10 of the ink transfer belt 6 engages the outer cylindrical surface or casing of the ink duct roller 2. If ink is conventionally adjusted zonewise by non-illustrated adjusting elements on the ink duct roller 2, in accordance with the respective ink requirement, a corresponding portion of ink is removed by the strand 10 from the surface of the ink duct roller 2. After the other strand or run 11 of the ink transfer belt 6 contacts the outer cylindrical surface of the next following distributor roller 4, the ink received from the ink duct roller 2 is surrendered to the distributor roller 4 and thus to the rollers 3, 4 of the inking unit.

In the illustrated embodiment of the invention, the ink transfer belt 6 is partly looped around the distributor roller 4 and is driven thereby at the same peripheral speed as that of the plate cylinder. Because the ink duct roller 2 rotates considerably slower than the distributor roller 4, metering of the supplied quantity of ink can be achieved as a measure of the difference in speed between that of the strand 10 and the outer cylindrical surface of the ink duct roller 2. The possibility arises, moreover, of having an influence over this quantity of ink positively or negatively by varying the drive speed of the ink duct roller 2.

In another embodiment of the invention, a guide roller 7, 8 or 9 is provided with a non-illustrated drive, so that the speed of the ink transfer belt 6 is controllable. In this regard, slip can be produced between the ink transfer belt 6 and the ink duct roller 2 as well as between the ink transfer belt 6 and the distributor roller 4 in order to meter the entire quantity of ink. In order to adjust the contact force both of the strand 10 as well as of the strand 11, one or more guide rollers 7, 8 and 9 can be mounted adjustably, in a conventional manner. One of the guide rollers 7, 8 and 9 is resiliently mountable for tensioning the ink transfer belt 6, one of the guide rollers being also able to carry non-illustrated guide pulleys at opposite ends thereof in order to prevent the ink transfer belt 6 from drifting off. Such guide pulleys have not been shown in the drawing because they are of conventional construction.

FIGS. 2 and 3 show respective modified guidance systems for the ink transfer belt 6 in order to permit an adjustment to the respective spatial conditions in the printing machine, without thereby modifying or impairing the function or the manner of operation of the device. The construction and the mounting of the ink transfer belt 6 with the guide rollers 7, 8 and 9 can also be effected as an exchangeable unit, the guide rollers being able to be mounted in bearing parts so that the installation thereof in the printing machine is facilitated, and also a retrofitting of machines already in operation can be effected. In all of these embodiments, none of the guide rollers around which the ink transfer belt 6 is slung is disposed in rolling contact with the ink transfer roller 2 or the first distributor roller 4.

The foregoing is a description corresponding, in substance, to German application No. P 35 31 433.8, dated Sept. 3, 1985, International priority of which is being claimed for the instant application, and which is hereby made part of this application. Any material discrepancies between the foregoing specification and the specification of the aforementioned corresponding German application are to be resolved in favor of the latter.

There is claimed:

1. Inking unit for a rotary printing machine having an ink duct, a relatively slowly rotating ink duct roller and following form and distributor rollers rotating at the same peripheral speed as that of a plate cylinder of the printing machine, comprising an endless ink transfer belt located downstream from the ink duct roller in transfer direction of ink from the ink duct, and guide rollers engaging and guiding said endless ink transfer belt, said endless ink transfer belt extending laterally across the length of the ink duct roller and having one run thereof engaging the outer cylindrical surface of the ink duct roller at a location of said one run distant from any of said guide rollers, the other run of said endless ink transfer belt, at a location of the other run also distant from any of said guide rollers, engaging the outer cylindrical surface of the next distributor roller disposed downstream from said endless ink transfer belt.

2. Inking unit according to claim 1 wherein said endless ink transfer belt partly surrounds and is driven by said next distributor roller.

3. Inking unit according to claim 1 wherein one of said guide rollers has a drive with means for controlling the speed of said endless ink transfer belt.

4. Inking unit according to claim 1 wherein one of said guide rollers is adjustably mounted.

5. Inking unit according to claim 1 wherein one of said guide rollers is resiliently mounted.

6. Inking unit according to claim 1 wherein one of said guide rollers carries a respective guide pulley on opposite ends thereof for guiding said endless ink transfer belt.

* * * * *